US009061500B2

(12) United States Patent
Chowdhury et al.

(10) Patent No.: US 9,061,500 B2
(45) Date of Patent: Jun. 23, 2015

(54) PRINTHEAD SUBSTRATE, METHOD OF MANUFACTURING THE SAME, PRINTHEAD, AND PRINTING APPARATUS

(71) Applicant: CANON KABUSHIKI KAISHA, Tokyo (JP)

(72) Inventors: Ershad Ali Chowdhury, Oita (JP); Takayuki Kimura, Oita (JP); Kenji Makino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/507,959

(22) Filed: Oct. 7, 2014

(65) Prior Publication Data

US 2015/0109370 A1 Apr. 23, 2015

(30) Foreign Application Priority Data

Oct. 22, 2013 (JP) ..... 2013-219505

(51) Int. Cl.
*B41J 2/05* (2006.01)
*B41J 2/16* (2006.01)
*B41J 2/14* (2006.01)

(52) U.S. Cl.
CPC ..... *B41J 2/1626* (2013.01); *B41J 2/14427* (2013.01); *B41J 2/1648* (2013.01)

(58) Field of Classification Search
USPC ..... 347/67, 59, 56, 62, 17, 58
See application file for complete search history.

(56) References Cited

U.S. PATENT DOCUMENTS 7,244,370 B2 7/2007 Sasaki et al.

FOREIGN PATENT DOCUMENTS

JP 2009-248517 A 10/2009

*Primary Examiner* — Henok Legesse
(74) *Attorney, Agent, or Firm* — Fitzpatrick, Cella, Harper & Scinto

(57) ABSTRACT

A method of manufacturing a printhead substrate, including forming a metal pattern, including a portion forming a pair of electrodes, on an insulating member, forming a conductive film which covers the insulating member and the metal pattern, including a first portion forming a temperature detection element and a second portion except for the first portion, etching the second portion so as to form the pair of electrodes, and etching the first portion so as to form the temperature detection element which is connected to the pair of electrodes, wherein an etching amount in the etching the second portion is larger than a thickness of the conductive film, and an etching amount in the etching the first portion is smaller than the etching amount in the etching the second portion.

6 Claims, 7 Drawing Sheets

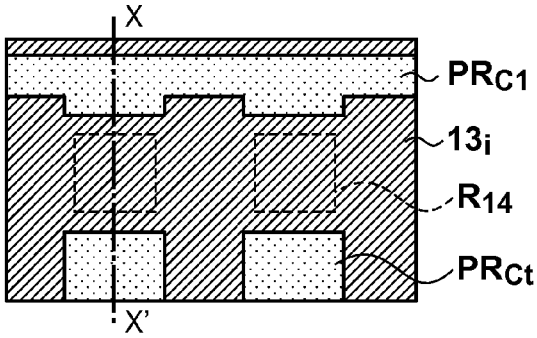
FIG. 2A1
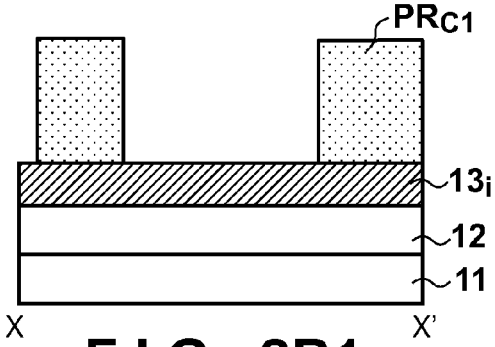
FIG. 2B1
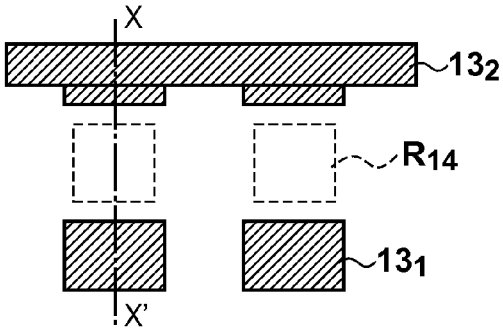
FIG. 2A2
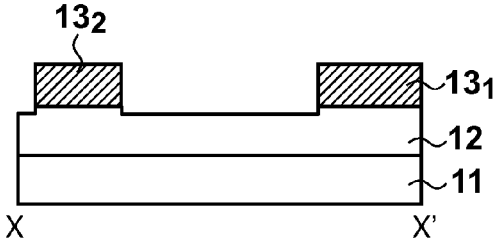
FIG. 2B2
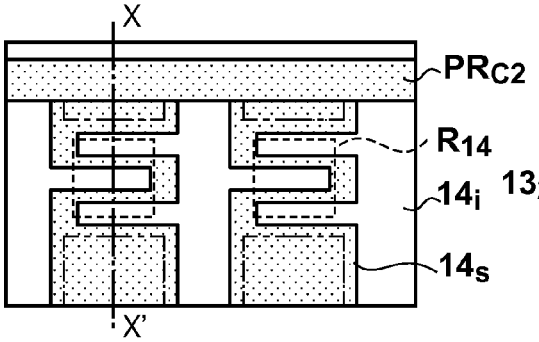
FIG. 2A3
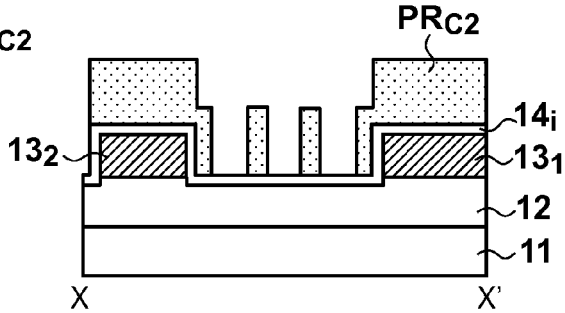
FIG. 2B3
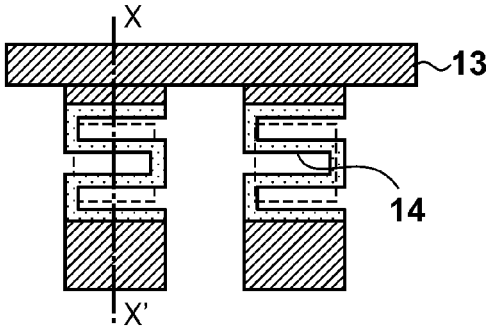
FIG. 2A4
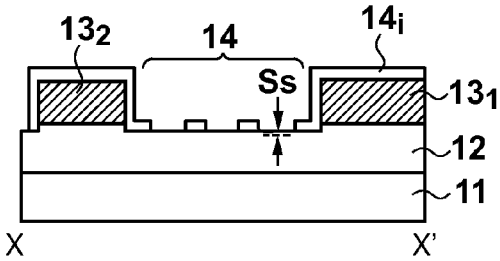
FIG. 2B4

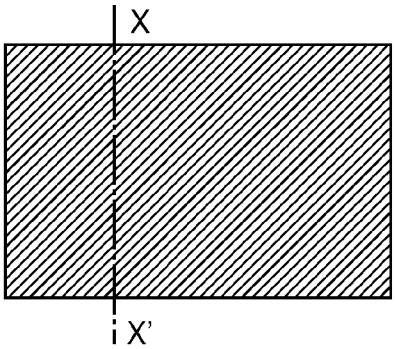
FIG. 5A1
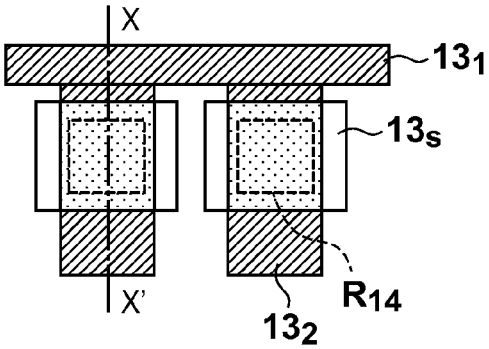
FIG. 5A4
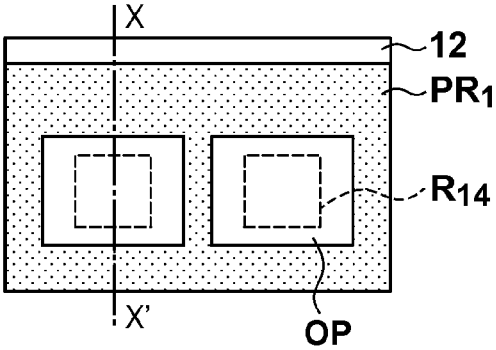
FIG. 5A2
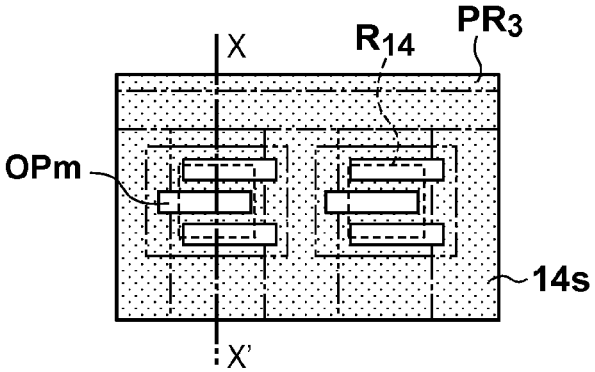
FIG. 5A5
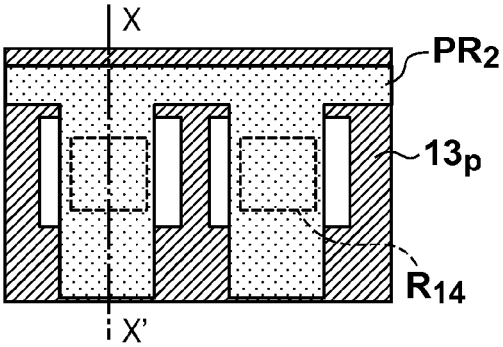
FIG. 5A3
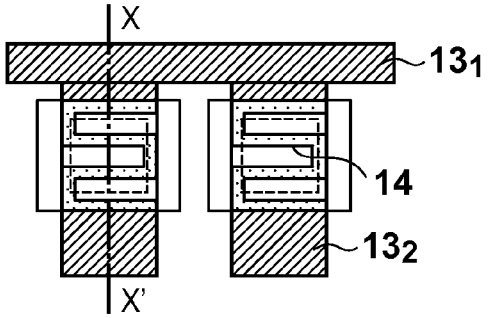
FIG. 5A6

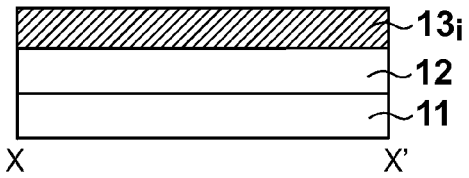
FIG. 5B1
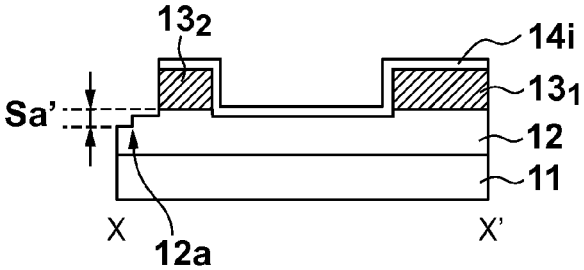
FIG. 5B4
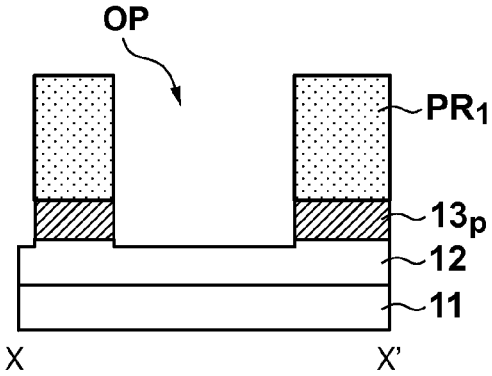
FIG. 5B2
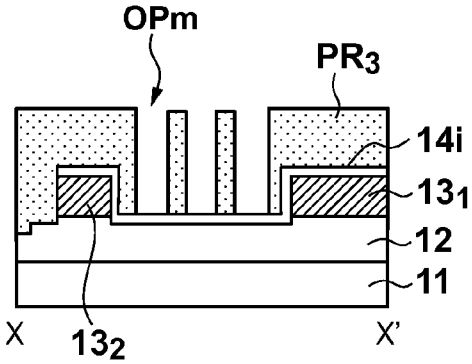
FIG. 5B5
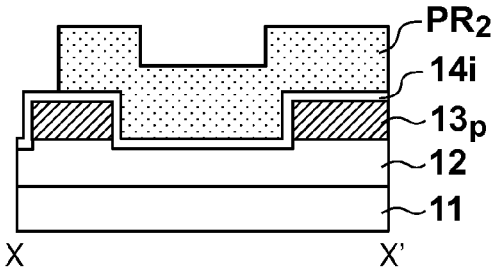
FIG. 5B3
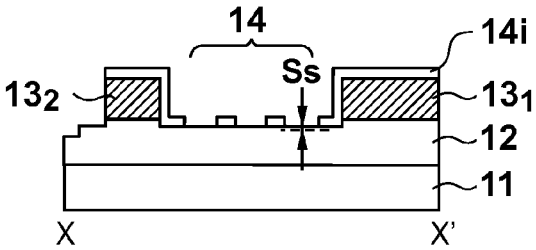
FIG. 5B6

PRINTHEAD SUBSTRATE, METHOD OF MANUFACTURING THE SAME, PRINTHEAD, AND PRINTING APPARATUS

BACKGROUND OF THE INVENTION

1. Field of the Invention

The present invention relates to a printhead substrate, a method of manufacturing the same, a printhead, and a printing apparatus.

2. Description of the Related Art

On a printhead substrate for performing inkjet printing, an electrothermal transducer for heating ink (printing material), and a temperature detection element for detecting the temperature of the electrothermal transducer can be provided.

Japanese Patent Laid-Open No. 2009-248517 discloses a printhead substrate on which a temperature detection element is formed on an insulating member (heat storage layer) on a silicon substrate, and an electrothermal transducer is formed on an interlayer insulating film on the temperature detection element. In addition to the temperature detection element, a plurality of wiring patterns which include electrodes connected to the temperature detection element are formed on the insulating member. According to Japanese Patent Laid-Open No. 2009-248517, after a metal member is formed on the insulating member to cover the plurality of wiring patterns, this metal member is patterned by etching, thereby forming the temperature detection element connected to the electrodes.

By performing over-etching (etching whose etching amount is larger than the thickness of the metal member) when etching the above-described metal member, the short circuit of the plurality of wiring patterns due to a residue which is caused by the etching can be prevented. However, if the etching amount of the over-etching is larger than necessary, a large step is formed on the upper surface of a structure in which the temperature detection element after the etching is formed. This step has an influence on the shape of the electrothermal transducer. For example, it impairs the flatness of the electrothermal transducer to be formed on the temperature detection element later. As a result, a decrease in the electrothermal transduction efficiency of the electrothermal transducer may occur.

SUMMARY OF THE INVENTION

It is an object of the present invention to provide a technique advantageous in preventing the short circuit of a wiring pattern while improving the electrothermal transduction efficiency of an electrothermal transducer.

One of the aspects of the present invention provides a method of manufacturing a printhead substrate which includes an electrothermal transducer, an insulating member, a pair of electrodes arranged on the insulating member, and a temperature detection element arranged on the insulating member, connected to the pair of electrodes, and configured to detect a temperature of the electrothermal transducer, comprising steps of forming, on the insulating member, a metal pattern which includes a portion forming the pair of electrodes such that a first region and a second region of the insulating member are not covered by the metal pattern, the first region being defined as a region where the temperature detection element is to be formed and the second region being adjacent to the first region, forming a conductive film to cover the insulating member and the metal pattern, forming a resist pattern which covers a first portion of the conductive film, the first portion being arranged on the first region and on the second region, etching a second portion except for the first portion of the conductive film using the resist pattern, and etching the first portion of the conductive film to form the temperature detection element having a shape for connecting portions of the conductive that are to be the pair of electrodes, wherein an etching amount in the step of etching the second portion is larger than a thickness of the conductive film, and an etching amount in the step of etching the first portion is smaller than the etching amount in the step of etching the second portion.

Further features of the present invention will become apparent from the following description of exemplary embodiments with reference to the attached drawings.

BRIEF DESCRIPTION OF THE DRAWINGS

FIGS. 2A1 to 2A4 and 2B1 to 2B4 are views for explaining a reference example of a method of manufacturing the printhead substrate;

FIGS. 5A1 to 5A6 and 5B1 to 5B6 are views for explaining a concrete example of the method of manufacturing the printhead substrate.

DESCRIPTION OF THE EMBODIMENTS

Example of Sectional Structure of Printhead Substrate

Figure 1:
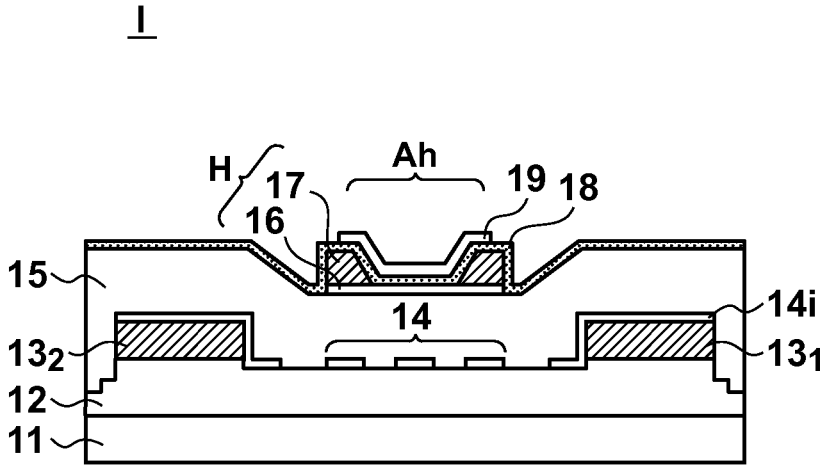
FIG. 1 is a schematic view for explaining an example of the sectional structure of a printhead substrate.

The sectional structure of a printhead substrate I will be described with reference to FIG. 1. The printhead substrate I includes, for example, a substrate 11, an insulating member 12, a wiring pattern including electrodes 13 ($\mathbf{13}_1$ and $\mathbf{13}_2$), a temperature detection element 14, a second insulating member 15, an electrothermal transducer H, a passivation film 18, and an anti-cavitation film 19.

The substrate 11 is made of a semiconductor such as silicon. Each element (not shown) such as an MOS transistor which forms a logic circuit for operating the printhead substrate I is formed on the substrate 11. A wiring pattern including the electrodes 13 and the temperature detection element 14 are arranged on the insulating member 12 on the substrate 11.

The temperature detection element 14 is arranged immediately under the electrothermal transducer H to draw near to the electrothermal transducer H through the insulating member 15, and detects the temperature of the electrothermal transducer H. The insulating member 12 uses, for example, a material with lower heat conductivity than that of the substrate 11, and functions as a heat storage layer. This improves the temperature detection accuracy of each temperature detection element 14. The electrodes $\mathbf{13}_1$ and $\mathbf{13}_2$ are a pair of electrodes provided at the two ends of the temperature detection element 14.

The electrothermal transducer H functions as a heater, and includes a metal member 16 serving as a heater layer and a pair of electrodes 17. An ink channel supplied with ink (printing material) is formed above the electrothermal transducer H. The electrothermal transducer H generates heat energy by being energized, and heats the ink in the vicinity of a heating region Ah. The heated ink foams, and is discharged from a nozzle (orifice) which is provided corresponding to the electrothermal transducer H.

The passivation film 18 functions as a protective film, and is arranged to cover the electrothermal transducer H. The passivation film 18 protects the electrothermal transducer H or the like from cavitation caused by ink.

The temperature detection element 14 is a resistive element, and detects a temperature by detecting the change in a resistance value caused by a temperature change. The temperature detection element 14 can be formed by a thin layer made of a metal such as Al, AlCu, Pt, Ti, TiN, TiSi, Ta, TaN, TaSiN, TaCr, Cr, CrSiN, or W. The temperature detection element 14 is preferably formed to have a larger resistance value to improve the temperature detection accuracy and disturbance noise resistance. The temperature detection element 14 is formed, for example, in a meander shape (serpentine shape). As a result, the high-resistance temperature detection element 14 with a narrow width and a long length is formed.

Reference Example

Prior to a description of each embodiment of the present invention, a reference example of a method of manufacturing a printhead substrate (to be referred to as a "printhead substrate $I_C$" hereinafter) will be described with reference to FIGS. 2A1, 2B1, 2A2, 2B2, 2A3, 2B3, 2A4, and 2B4 to FIGS. 3A and 3B. FIGS. 2A1, 2B1, 2A2, 2B2, 2A3, 2B3, 2A4, and 2B4 are schematic views for explaining each step of the reference example. FIGS. 2A1 to 2A4 are plan views in the respective steps, and FIGS. 2B1 to 2B4 are sectional views taken along a cut line X-X' of the plan views. Note that each of these steps is performed using a known semiconductor manufacturing process.

The step of FIGS. 2A1 and 2B1 will be described. A metal member 13*i* is formed on an insulating member 12 on a substrate 11 made of a semiconductor such as silicon. Subsequently, a resist pattern $PR_{C1}$ is formed on the metal member 13*i*. The resist pattern $PR_{C1}$ has a pattern for forming a wiring pattern including a pair of electrodes 13. Each region $R_{14}$ in FIG. 2A1 surrounded by a dashed line indicates a region where a temperature detection element 14 should be formed later.

The step of FIGS. 2A2 and 2B2 will be described. A part of the metal member 13*i* is removed by dry etching using the resist pattern $PR_{C1}$, thereby forming the wiring pattern including the pair of electrodes 13. In FIGS. 2A2 and 2B2, two pairs of electrodes 13 are shown. For each of two pairs of electrodes 13, one-side electrodes (electrodes $\mathbf{13}_1$) are formed to be electrically separated from each other, and the other-side electrode (electrode $\mathbf{13}_2$) is a common electrically connected electrode. Note that FIG. 2B2 illustrates, in this step, a mode in which a part of the insulating member 12 is also removed by so-called over-etching.

The step of FIGS. 2A3 and 2B3 will be described. A conductive film 14*i* is formed on the insulating member 12 to cover the wiring pattern including the pair of electrodes 13. A resist pattern $PR_{C2}$ is additionally formed on the conductive film 14*i*. The resist pattern $PR_{C2}$ has a pattern for forming the temperature detection elements 14, and here has a pattern for forming the temperature detection elements 14 each having the above-described meander shape.

The step of FIGS. 2A4 and 2B4 will be described. A part of the conductive film 14*i* is removed by dry etching using the resist pattern $PR_{C2}$, thereby forming the temperature detection elements 14. Following the above-described procedure, the temperature detection elements 14 can be formed.

In the step of FIGS. 2A3 and 2B3 (the step of forming the conductive film 14*i* and then forming the resist pattern $PR_{C2}$), the conductive film 14*i* is initially formed on the insulating member 12 to cover the wiring pattern including the pair of electrodes 13. Therefore, in this stage, the respective portions, out of the wiring pattern, that should electrically be separated are electrically connected to each other. More specifically, the pair of electrodes 13 (the electrode $\mathbf{13}_1$ and the electrode $\mathbf{13}_2$) are shorted to one another. For this reason, in the step of FIGS. 2A4 and 2B4 (an etching step using the resist pattern $PR_{C2}$), over-etching, that is etching with a thickness larger than that of the conductive film 14*i* needs to be performed. This is because the residue of electrically conductive materials such as the electrodes 13 and the conductive film 14*i* can be generated in the etching step, so even after the etching, the above-described respective portions that should electrically be separated may remain shorted to one another.

According to this over-etching, as shown in FIG. 2B4, steps Ss caused by removing the part of the insulating member 12 can be formed in a portion of the temperature detection element 14.

Figure 3A:
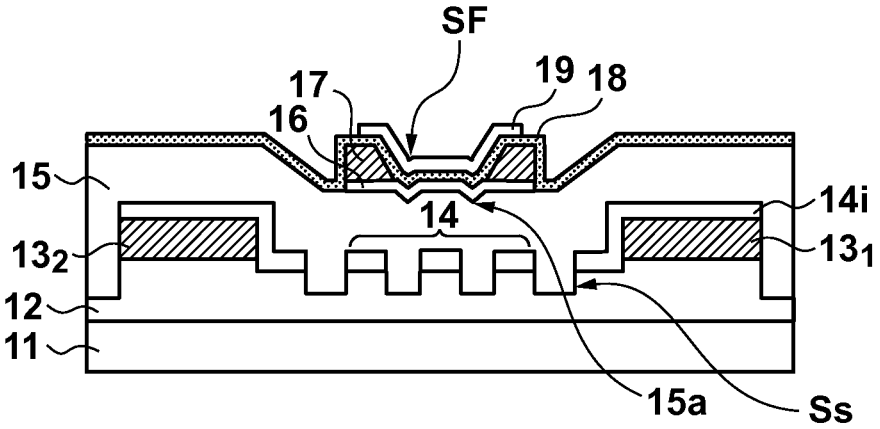
FIGS. 3A and 3B are schematic views for explaining a reference example of the sectional arrangement of the printhead substrate.
Figure 3B:
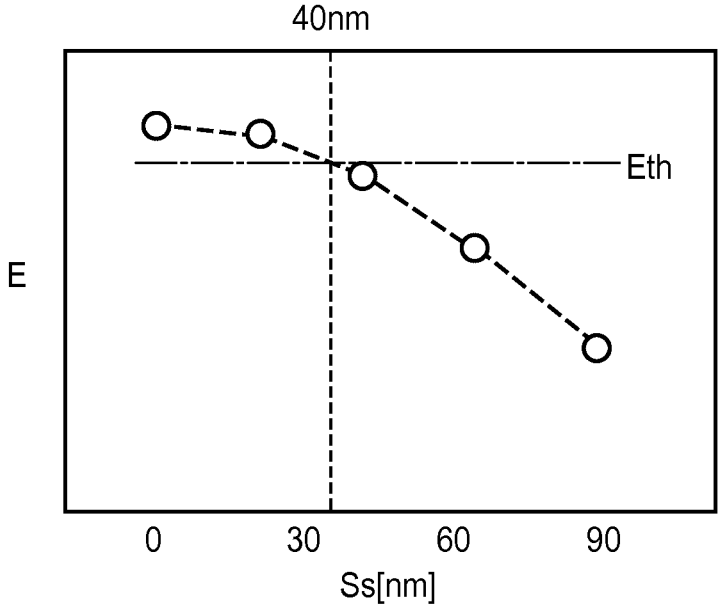

FIGS. 3A and 3B are views for explaining an influence by these steps Ss. FIG. 3A is a schematic view for explaining a structure having the large steps Ss. If the steps Ss are large, steps 15*a* are also formed on the upper surface of an insulating member 15, thereby impairing the flatness of an electrothermal transducer H formed on it. More specifically, the flatness of a metal member 16 of a heater layer included in the electrothermal transducer H is impaired, decreasing the electrothermal transduction efficiency of the electrothermal transducer H. For the same reason, the temperature detection element 14 cannot detect the temperature of the electrothermal transducer H at a high accuracy.

A step (SF) is also formed on a surface which contacts ink (the upper surface of an anti-cavitation film 19). Accordingly, when printing is performed, ink is not heated appropriately in the above-described heating region Ah even if the electrothermal transducer H is driven. As a result, the printing performance of a printhead drops.

FIG. 3B is a graph obtained by plotting energy supplied to ink for each step Ss. The abscissa represents the step Ss [nm], and the ordinate represents energy E supplied to the ink. According to FIG. 3B, the energy E supplied to the ink decreases with an increase in the step Ss. The alternate long and short dashed line in FIG. 3B indicates energy Eth necessary to perform printing. If E<Eth, printing cannot be performed. That is, according to FIG. 3B, the step Ss is preferably suppressed to be 40 nm or less.

First Embodiment

The first embodiment will be described with reference to FIGS. 4A to 4D and FIGS. 5A1, 5B1, 5A2, 5B2, 5A3, 5B3, 5A4, 5B4, 5A5, 5B5, 5A6, and 5B6. FIGS. 4A to 4D are schematic views for explaining main steps until temperature detection elements 14 are formed in an example of a method of manufacturing a printhead substrate (to be referred to as a "printhead substrate $I_1$") according to this embodiment. The printhead substrate $I_1$ can be manufactured using a known semiconductor manufacturing process.

Figure 4A:
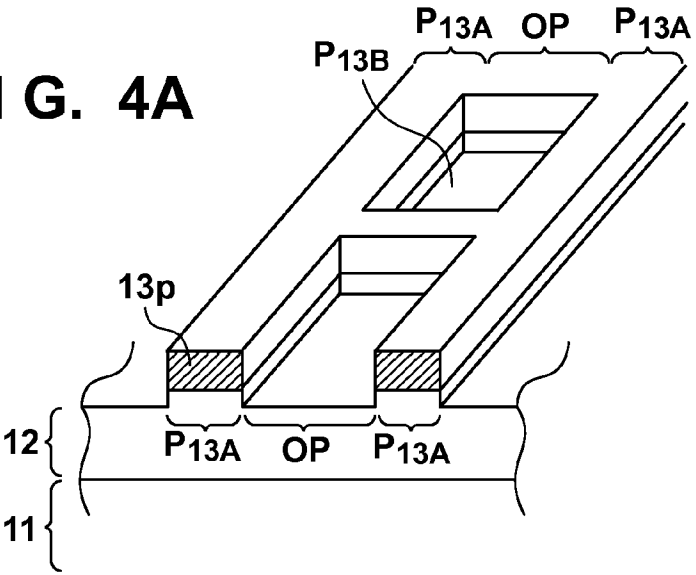
FIGS. 4A to 4D are views for explaining an example of the method of manufacturing the printhead substrate.

In the step of FIG. 4A, a metal pattern $\mathbf{13}_P$ is formed on an insulating member 12 on a substrate 11 made of a semiconductor such as silicon. This is performed, for example, by etching a metal member (or a metal film) after forming the metal member on the insulating member 12 on the substrate 11. Note that FIG. 4A illustrates, in this step, a mode in which a part of the insulating member 12 is also reduced by so-called over-etching.

In a sectional view of FIG. 4A, the metal pattern $13_P$ has openings OP and a pair of portions $P_{13A}$ which sandwiches the openings OP. A region where each opening OP is provided is a region where a temperature detection element should be formed later. The pair of portions $P_{13A}$ will serve as a pair of electrodes 13 for the temperature detection elements 14 to be formed later. Note that although a portion $P_{13B}$ is formed between the openings OP adjacent to each other to divide them, the portion $P_{13B}$ may not be formed. That is, in this step, the openings OP suffice to be formed to expose at least a portion, out of the insulating member 12, corresponding to the region where the temperature detection elements 14 should be formed later.

Figure 4B:
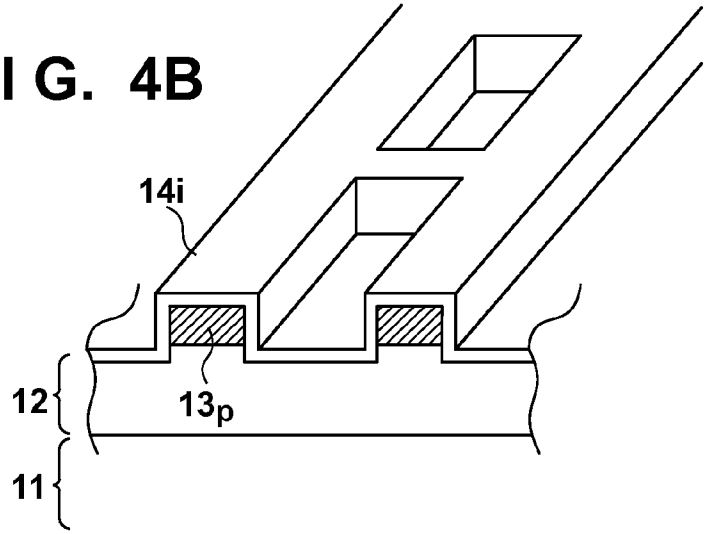

In the step of FIG. 4B, a conductive film 14*i* (the film thickness is about 30 nm) is formed on the insulating member 12 to cover the metal pattern $13_P$. The conductive film 14*i* will be patterned later, resulting in formation of the temperature detection elements 14.

Figure 4C:
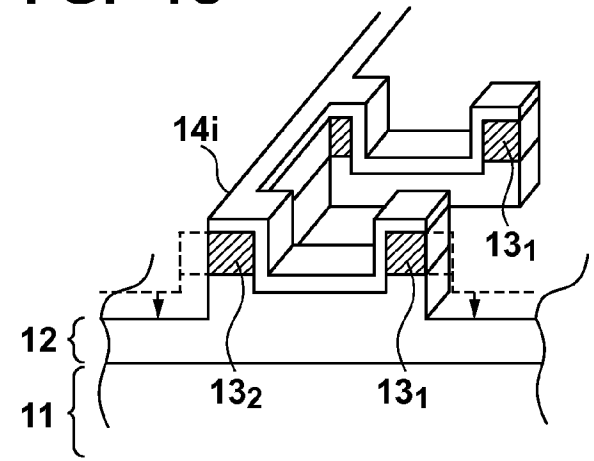

In the step of FIG. 4C, the conductive film 14*i* and the metal pattern $13_P$ are etched. This is performed using a resist pattern formed on the conductive film 14*i* to cover (at least a part of) the pair of portions $P_{13A}$ and a region between the pair of portions $P_{13A}$ (a region of each opening OP). Here, the resist pattern is formed to cover the part of the pair of portions $P_{13A}$. As a result, the metal pattern $13_P$ as well as the conductive film 14*i* are etched, thereby forming the pair of electrodes 13 ($13_1$ and $13_2$).

Moreover, in this step, the so-called over-etching is performed, thereby removing at least the part of the insulating member 12 under a portion of the conductive film 14*i* exposed by the resist pattern. In other words, etching whose amount is larger than the thickness of the conductive film 14*i* is performed in this step. This electrically separates the respective portions of the metal pattern $13_P$ that should be separated from each other appropriately to avoid a short circuit due to a residue which is caused by the etching. Here, one of the pair of portions $P_{13A}$ and the other of the pair of portions $P_{13A}$ are separated from each other. That is, the respective electrodes $13_1$ separated from each other are formed to correspond to the individual temperature detection elements 14 to be formed later. Furthermore, etching is performed so as not to separate the other of the pair of portions $P13_A$ from the other of another pair of portions $P13_A$. That is, the electrode $13_2$ connected in common to the individual temperature detection elements 14 to be formed later is formed.

Figure 4D:
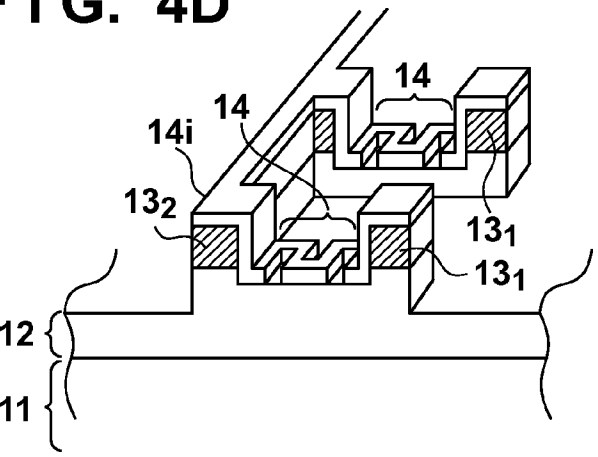

In the step of FIG. 4D, patterning is performed on a portion of the conductive film 14*i* between the pair of electrodes 13 (between the electrodes $13_1$ and $13_2$), thereby forming the temperature detection elements 14. As described above, each temperature detection element 14 is formed, for example, in a meander shape. This patterning is performed by etching. The conductive film 14*i* is a thin film with a thickness of about, for example, 30 nm. The etching rate of the conductive film 14*i* may be lowered to suppress over-etching. The etching rate may be set to be, for example, lower than that in the step of FIG. 4C.

According to the above-described manufacturing steps, it is possible to form the temperature detection elements 14 to avoid the portions of the metal pattern $13_P$ that should be separated from each other from becoming shorted to one another, and to prevent a large step from being formed on the upper surface of a structure immediately after the formation of the temperature detection elements 14. The temperature detection elements 14 may be formed by lowering the etching rate of the conductive film 14*i* (the film thickness is about 30 nm at most). This reduces the etching amount of the insulating member 12 by over-etching, thus preventing the formation of the large step on the upper surface of the structure immediately after the etching.

The above-described manufacturing steps will be described in detail below with reference to FIGS. 5A1, 5B1, 5A2, 5B2, 5A3, 5B3, 5A4, 5B4, 5A5, 5B5, 5A6, and 5B6. FIGS. 5A1, 5B1, 5A2, 5B2, 5A3, 5B3, 5A4, 5B4, 5A5, 5B5, 5A6, and 5B6 are schematic views for explaining respective steps. FIGS. 5A1 to 5A6 are plan views in the respective steps, and FIGS. 5B1 to 5B6 are sectional views taken along a cut line X-X' of the plan views.

The step of FIGS. 5A1 and 5B1 will be described. The substrate 11 made of a semiconductor such as silicon is prepared. Each element such as an MOS transistor which forms a logic circuit for operating the printhead substrate $I_1$ is formed on the substrate 11. More specifically, for example, a gate insulating film is formed by a thermal oxidation process, a gate electrode is formed by a deposition method and etching, and also diffusion regions such as p- or n-type drain and source can be formed by ion implantation and annealing. Then, the insulating member 12 ($SiO_2$) is formed on the substrate 11 by, for example, the thermal oxidation process. The insulating member 12 can be formed to a thickness of about, for example, several μm, and functions as a heat storage layer with a comparatively low heat conductivity. Then, a metal member 13*i* (the thickness is about 400 nm) such as Al is additionally formed on the insulating member 12 by, for example, a sputtering method.

The step of FIGS. 5A2 and 5B2 will be described. A resist pattern $PR_1$ is formed on the metal member 13*i* by a photolithography method. Then, the metal member 13*i* is etched by dry etching using the resist pattern $PR_1$, thereby forming the metal pattern $13_P$ having the openings OP. Note that each region $R_{14}$ in FIG. 5A2 surrounded by a dashed line indicates a region where the temperature detection element 14 should be formed later. That is, in this step, formation of the wiring pattern including the above-described pair of electrodes 13 has not been completed yet, and only portions, out of the metal member 13*i*, corresponding to the regions $R_{14}$ and their peripheral regions are etched. Note that the part of the insulating member 12 can be removed by over-etching in this step.

The step of FIGS. 5A3 and 5B3 will be described. The conductive film 14*i* is formed, by the sputtering method or the like, on the insulating member 12 to cover the metal pattern $13_P$. In order to increase the resistance of the temperature detection element 14 to be formed later, the conductive film 14*i* is preferably formed to have a thin film (the film thickness falls within a range of, for example, 10 nm (inclusive) to 40 nm (inclusive)), and is appropriately formed to the film thickness of about 30 nm. A metal material such as Al, AlCu, Pt, Ti, TiN, TiSi, Ta, TaN, TaSiN, TaCr, Cr, CrSiN, or W can be used for the conductive film 14*i*. Then, a resist pattern $PR_2$ is formed on the conductive film 14*i*. The resist pattern $PR_2$ is formed to cover a pair of portions (portions that should be the pair of electrodes 13) of the metal pattern $13_P$ and a region between the pair of portions (region $R_{14}$).

The step of FIGS. 5A4 and 5B4 will be described. A part of the conductive film 14*i* and a part of the metal pattern $13_P$ are removed by, for example, dry etching using the resist pattern $PR_2$. Accordingly, a wiring pattern including a plurality of pairs of electrodes 13 ($13_1$ and $13_2$) is formed (two pairs of electrodes 13 are shown in FIGS. 5A4 and 5B4). Note that for each of the plurality of pairs of electrodes 13, one-side electrodes (the electrodes $13_2$) are separated from each other to correspond to the respective regions $R_{14}$, and the other-side electrode (the electrode $\mathbf{13}_1$) is a commonly connected electrode.

In this step, over-etching, that is etching with a thickness larger than that of the conductive film 14*i* (about 30 nm) is performed. As shown by a step Sa' in FIG. 5B4, this removes a portion 12*a* of the insulating member 12. Note that since a portion immediately under the metal pattern $\mathbf{13}_P$ and other portions of the insulating member 12 are different in removal amount, steps can also be formed between these portions.

The etching rate rM of the metal member 13*i* or the metal pattern $\mathbf{13}_P$ and the conductive film 14*i* is about 800 nm/min, and an etching rate rA of the insulating member 12 is about 160 nm/min. Hence, for example, time (period) $tj_1$ required to etch the 30-nm thick conductive film 14*i* is $tj_1=(400+30)/rM=0.54$ min. However, if the etching is performed only for the time $tj_1$, a residue can remain by, for example, an underlying step, a variation in the etching rate, and the nonuniform distribution of a processing target. To prevent this residue, over-etching which requires about 1.2 to 1.5 times as long as the time $tj_1$ is typically performed. That is, performing over-etching on a peripheral portion of the temperature detection element 14 to be formed later and the pair of electrodes 13 in a planar view prevents the temperature detection element 14 to be formed later from being shorted to another signal line and a power supply line.

Consider a case, for example, in which etching is performed for time $tj_1\times1.2$. The time required to expose the insulating member 12 is 30/rM. Accordingly, the time required to etch the insulating member 12 is $tj_1\times1.2-30/rM$. Therefore, the above-described step Sa' is $Sa'=rA\times(tj_1\times1.2-30/rM)$. According to the above-described etching rate, the step Sa' is about 100 nm.

The step of FIGS. 5A5 and 5B5 will be described. A resist pattern $PR_3$ having openings OPm where the temperature detection element 14 is to be formed on the conductive film 14*i* is formed. Then, the part of the conductive film 14*i* is removed by dry etching using the resist pattern $PR_3$, thereby forming the temperature detection element 14. In this step, etching is performed on the conductive film 14*i* with the thickness of about 30 nm at most. In order to reduce an etching amount by over-etching, it is preferable that the etching is performed at a comparatively low etching rate and an appropriate etching condition is set. Note that the openings OPm can only be formed in a portion where the temperature detection element 14 is to be formed. Accordingly, the temperature detection element 14 in the above-described meander shape is formed.

A structure illustrated in FIGS. 5A6 and 5B6 is obtained through the above-described steps. A time $tj_2$ required to etch the conductive film 14*i* is, for example, $tj_2=(30/rM)$. As described above, etching of the conductive film 14*i* to form the temperature detection element 14 is preferably performed so as not to be over-etching. However, if over-etching whose etching time is $tj_2\times1.2$ is to be performed, the time of etching the insulating member 12 is $tj_2\times0.2$. At this time, steps Ss on the insulating member 12 formed by the over-etching is $Ss=rA\times(tj_2\times0.2)=1.2$ nm, approximately. Hence, even if the thickness (about 30 nm) of the temperature detection element 14 itself is considered, a step (total) that can be formed on the upper surface of the structure immediately after the formation of the temperature detection element 14 is 40 nm or less.

From another point of view, an etching amount (including the etching amount of the insulating member 12, in addition to the etching amount of the conductive film 14*i*) in the step of FIGS. 5A4 and 5B4 is smaller than that in the step of FIGS. 5A6 and 5B6. As a result, there is obtained a structure in which the upper portion of at least a part of the insulating member 12 between the pair of electrodes 13 and another electrode or the wiring pattern is located lower than the upper surface of the portion of the insulating member 12 which contacts the temperature detection element 14.

After the above-illustrated steps, an electrothermal transducer H is formed on an insulating member 15 on the temperature detection element 14. More specifically, the insulating member 15 (for example, P—SiO) with a thickness of about 900 nm is formed. Then, a metal member 16 of a heater layer made of TaSiN or the like is formed, and a pair of electrodes 17 made of Al or the like is formed at its two ends. Then, a passivation film 18 (for example, P—SiN) with a thickness of about 300 nm is formed to cover the electrothermal transducer H and the insulating member 15. Then, an anti-cavitation film 19 (for example, Ta, W, Pt, Ir, and Ru, or a compound of them) with a thickness of about 230 nm is additionally formed on the passivation film 18 across a heating region Ah. Following the above-described procedure, the printhead substrate $I_1$ is obtained.

As described above, according to this embodiment, it is possible to prevent the large step from being formed on the upper surface of the structure immediately after the formation of the temperature detection element 14. The step amount can be set to be 40 nm or less. This makes it possible to appropriately form the electrothermal transducer H on the insulating member 15 on the temperature detection element 14 later. More specifically, the metal member 16 of the heater layer included in the electrothermal transducer H is flat (the step amount on the lower surface is 40 nm or less), thus preventing a decrease in electrothermal transduction efficiency. For the same reason, this embodiment is also advantageous in improving the temperature detection accuracy of the temperature detection element 14. Furthermore, since a large step is not formed on the upper surface of the anti-cavitation film 19 either, ink is discharged appropriately when printing is performed with mounting the printhead substrate $I_1$ in a printhead. This is also advantageous in improving the printing performance of the print head.

Second Embodiment

The second embodiment will be described with reference to FIGS. 6A to 6D. In the patterning step of the metal member 13*i* according to the first embodiment, the opening OP is provided on the metal member to expose the portion, out of an insulating member 12, corresponding to the region where the temperature detection element should be formed later. The formation of the wiring pattern including the pair of electrodes 13 is completed in the subsequent step. However, the present invention is not limited to this embodiment. As in the embodiment that will be described below, for example, formation of a wiring pattern including a pair of electrodes 13 may be completed in the patterning step of a metal member 13*i*.

FIGS. 6A to 6D are schematic views for explaining, as in the first embodiment (FIGS. 4A to 4D), main steps until temperature detection elements are formed in an example of a method of manufacturing a printhead substrate (to be referred to as a "printhead substrate $I_2$") according to this embodiment.

Figure 6A:
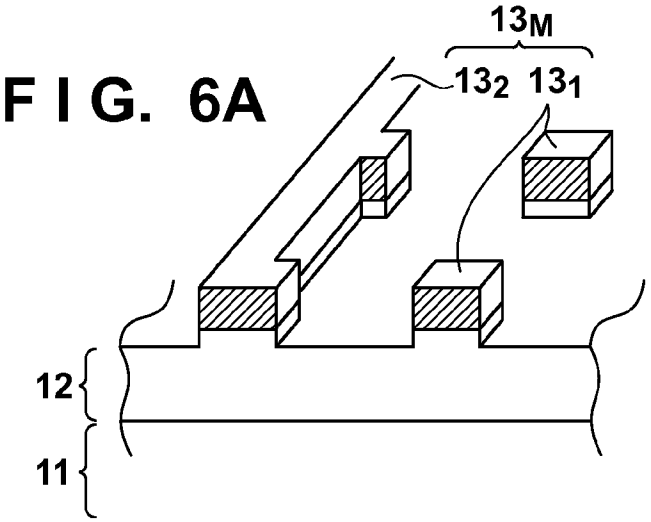
FIGS. 6A to 6D are views for explaining an example of a method of manufacturing a printhead substrate.

In the step of FIG. 6A, a wiring pattern $\mathbf{13}_M$ is formed on the insulating member 12 on a substrate 11. The wiring pattern $\mathbf{13}_M$ includes the above-described plurality of pairs of the electrodes 13. For each of the plurality of pairs of electrodes 13, one-side electrodes (electrodes $\mathbf{13}_1$) are formed to be separated from each other, and the other-side electrode (electrode $13_2$) is a commonly connected electrode. Each region between the pair of electrodes 13 (between the electrodes $13_1$ and $13_2$) is a region where the temperature detection element should be formed later. That is, in this step, the wiring pattern $13_M$ suffices to be formed to expose at least a portion, out of the insulating member 12, corresponding to each region where the temperature detection element should be formed later. In this embodiment, the formation of the wiring pattern $13_M$ is completed in this step. In other words, the formation of the wiring pattern $13_M$ is completed at the same time as the patterning of the metal member 13*i*.

Figure 6B:
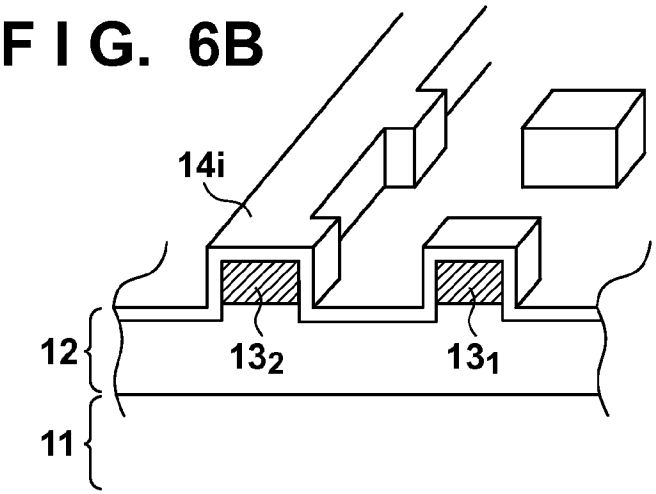

In the step of FIG. 6B, a conductive film 14*i* (the film thickness is about 300 nm) is formed on the insulating member 12 to cover the wiring pattern $13_M$.

Figure 6C:
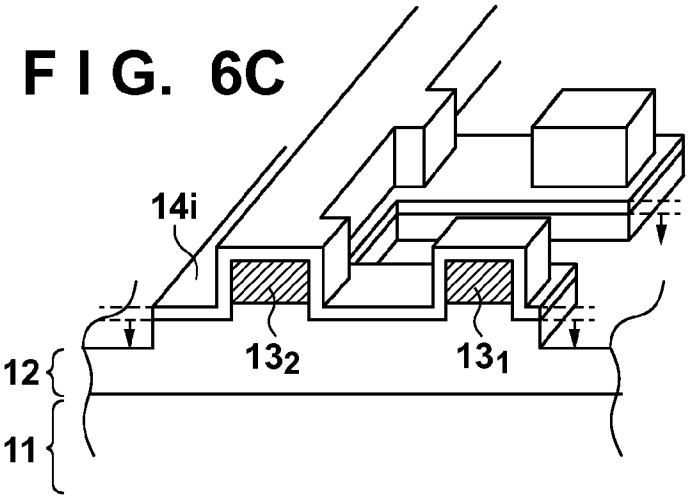

In the step of FIG. 6C, the conductive film 14*i* is etched. This step electrically separates, by the over-etching described in the first embodiment, the respective electrodes $13_1$ that should be separated appropriately to avoid them from becoming shorted to one another.

Figure 6D:
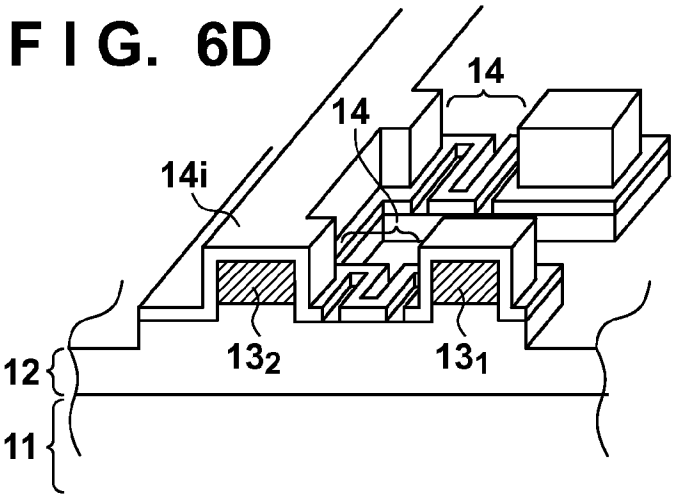

In the step of FIG. 6D, patterning is performed on a portion of the conductive film 14*i* between the pair of electrodes 13, thereby forming temperature detection elements 14 each having a meander shape. As described above, this patterning is performed by etching, and its etching rate may be lowered to suppress over-etching of the insulating member 12.

The above-described manufacturing steps also make it possible to form the temperature detection elements 14 to avoid the respective portions of the wiring pattern $13_M$ that should be separated from each other from becoming shorted to one another, and to prevent a large step from being formed on the upper surface of a structure immediately after the formation of the temperature detection elements 14. Hence, the same effect as in the first embodiment is also obtained by the manufacturing steps according to this embodiment.

(Others)

Two embodiments have been exemplified above. However, the present invention is not limited to these embodiments. The present invention may appropriately modify the materials of respective members and parameters and combine them with another known technique, without departing from the scope of the present invention.

For example, modifications may be performed on some of the steps of the manufacturing method exemplified in the above embodiments. For example, an etching step by dry etching may be performed by wet etching which can increase the etching selectivity of a target. Furthermore, for example, some of the steps may be omitted, and their order may be changed.

Similarly, modifications may be performed on a part of the structure exemplified in the above embodiments. For example, although the structure in which the pair of electrodes 13 and the temperature detection elements 14 are formed on the same line has been exemplified, the present invention is not limited to this structure. Also, in the above embodiments, the temperature detection elements 14 each formed in the meander shape have been illustrated to increase their resistance values. However, the present invention is not limited to this shape.

A printing apparatus which performs inkjet printing includes a printhead. The above-described printhead substrate $I_1$ or $I_2$ is mounted on the printhead. The printing apparatus scans a printhead relative to the printing medium while conveying a printing medium, thereby performing printing on the printing medium. A plurality of nozzles (orifices) are provided in the printhead to correspond a plurality of electrothermal transducers included on the printhead substrate. Ink (printing material) is discharged from the corresponding nozzle to the printing medium in response to driving of a given electrothermal transducer.

Note that "printing" can include, in addition to printing which forms significant information such as characters and graphics, printing in a broad sense regardless of whether it is significant or insignificant. For example, "printing" may not be so visualized as to be visually perceivable by humans, and can also include printing which forms images, figures, patterns, structures, and the like on the printing medium, or printing which processes the medium.

A "printing material" can include not only the "ink" used in the above-described embodiments but also consumables used for printing. The "printing material" can include, for example, not only a material used for forming the images, the figures, the patterns, and the like when applied onto the printing medium but also a liquid used for printing medium processing or ink processing (for example, solidification or insolubilization of a coloring material contained in the ink to be applied to the printing medium). The present invention may adopt not an arrangement which applies ink onto the printing medium directly but an arrangement which, for example, performs printing by applying ink onto an intermediate transfer material, and then transferring the ink to the printing medium. Further, the present invention may adopt not an arrangement which performs color printing by using a plurality of types of inks but an arrangement which performs monochrome printing by using one type of ink (for example, black).

Also, the "printing medium" can include not only paper used in general printing apparatuses, but also materials capable of accepting printing materials, such as cloth, a plastic film, a metal plate, glass, ceramics, resin, wood, and leather.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-219505, filed Oct. 22, 2013, which is hereby incorporated by reference herein in its entirety.

What is claimed is:

1. A printhead substrate comprising:

an electrothermal transducer;

a temperature detection element configured to detect a temperature of the electrothermal transducer; and a pair of electrodes provided at two ends of the temperature detection element, wherein the temperature detection element and the pair of electrodes are arranged on an insulating member on a substrate, wherein the printhead substrate further comprises a member arranged on the insulating member in a position away from the pair of electrodes, and made of the same material as the pair of electrodes, and wherein an upper surface of a first portion of the insulating member between the pair of electrodes and the member is located lower than an upper surface of a second portion of the insulating member which is in contact with the temperature detection element.

2. A printhead comprising:

the printhead substrate defined in claim 1; and an orifice configured to discharge a printing material in response to driving of the electrothermal transducer of the printhead substrate.

3. A printing apparatus comprising the printhead defined in claim 2.

4. The printhead substrate according to claim 1, wherein the electrothermal transducer is formed on a second insulating member on the temperature detection element, wherein the electrothermal transducer includes a second metal member formed on the second insulating member, and wherein a step amount on a lower surface of the second metal member is not more than 40 nm.

5. The printhead substrate according to claim 1, wherein a thickness of a conductive film forming the temperature detection element is from 10 nm to 40 nm.

6. The printhead substrate according to claim 1, wherein the temperature detection element has a meander shape in a planar view.

* * * * *